United States Patent [19]

Domke

[11] 3,942,301

[45] Mar. 9, 1976

[54] APPARATUS FOR PRODUCING LOW-OXYGEN CONTENT PACKAGES

[75] Inventor: Klaus Domke, Stuttgart-Weilimdorf, Germany

[73] Assignee: Fr. Hesser Maschinenfabrik AG, Stuttgart - Bad Cannstatt, Germany

[22] Filed: May 20, 1975

[21] Appl. No.: 579,097

Related U.S. Application Data

[63] Continuation-in-part of Ser. No. 367,645, June 6, 1973, abandoned.

[52] U.S. Cl. ..... 53/110; 53/112 R; 53/112 B

[51] Int. Cl.[2] ..... B65B 31/02

[58] Field of Search.... 53/7, 12, 110, 112 R, 112 B; 141/7, 66, 64

[56] References Cited

UNITED STATES PATENTS

| | | | |
|---|---|---|---|
| 1,406,380 | 2/1922 | Heath et al. | 141/64 X |
| 1,673,236 | 6/1928 | Fleischer | 53/124 B |
| 2,768,487 | 10/1956 | Day et al. | 53/110 X |
| 2,817,936 | 12/1957 | Peterson | 53/126 |
| 3,619,975 | 11/1971 | Johnson et al. | 53/110 X |

*Primary Examiner*—Travis S. McGehee

*Attorney, Agent, or Firm*—Edward E. Sachs

[57] ABSTRACT

A packaging apparatus for forming, filling and gas flushing, evacuating and sealing packaging materials to produce low-oxygen content packages. The apparatus contains a conveyor for transferring packaging containers from a container forming work station to various intermediate work stations to an evacuating and sealing station and thence to an exit station of the packaging machine. A protective gas-confining cover is provided over the path followed by the containers, and gas-flushing means are provided for the filler materials and the containers.

7 Claims, 5 Drawing Figures

APPARATUS FOR PRODUCING LOW-OXYGEN CONTENT PACKAGES

This application is a continuation-in-part of application Ser. No. 367,645, filed June 6, 1973, and now abandoned.

The invention relates generally to packaging machines and more specifically to machines for producing packages having a low-oxygen content.

The apparatus to which this invention pertains relates to a method of producing low-oxygen content packages in which an inert, or protective gas is passed in counterflow through the filler material, or contents of the package, during the filling operation and the gases contained in the filler material are partly or almost wholly drawn off before an air-tight seal is formed to close the package. The method may be used on prefabricated packaging containers as well as tubular bag packages and the evacuation process may be carried out in evacuation chambers.

In the operation of packaging machines, it is desirable to be able to check the weight of a filled container and to remove an incorrectly filled container from the machine before it is sealed. The path between the filling and evacuating stations may be relatively long necessitating a larger supply of the protective gas. Also, since some packaging containers are not rigid, they may change shape during the weight check causing a "breathing" effect. In order to prevent entry of air into the package under these conditions, the amount of protective gas supplied must be increased. This increases the cost of the operation.

It is the primary object of the present invention to provide an apparatus for producing low-oxygen content packaging containers.

A further object of the present invention is to provide an apparatus for producing low-oxygen content packages, including prefabricated ones, in which the apparatus includes a gas distributing and cover means which minimizes the use of the protective gas.

An aspect of the invention resides in providing an apparatus for producing low-oxygen content packages and in which a protective gas is supplied and confined by a cover arranged above the path along which the packages travel during the packaging operation. The cover is arranged over a conveyor to carry the packages and extends substantially from a filling station past intermediate work stations to an evacuating station having at least one working chamber.

A further aspect of the present invention resides in the provision of an apparatus which forms part of a packaging machine used for forming, filling and gas flushing, evacuating, and sealing of packaging material. The apparatus includes a cover having a protective-gas distributing duct in the upper portion thereof. The protective gas passes into a channeled, or skirted, space above and around the packages through a plurality of small, finely spaced apertures in the lower surface of the distributing duct.

Another aspect of the present invention resides in the provision of an additional gas-flushing station between the filling station and the evacuating station to act on the unfilled space, or head area, of the packaging container and thus to permit a reduction in the amount of gas necessary to produce low-oxygen content packages. The economics of the operation can therefore be improved.

For a better understanding of the present invention, together with other and further objects thereof, reference is had to the following description taken in connection with the accompanying drawings, and its scope will be pointed out in the appended claims.

Figure 1:
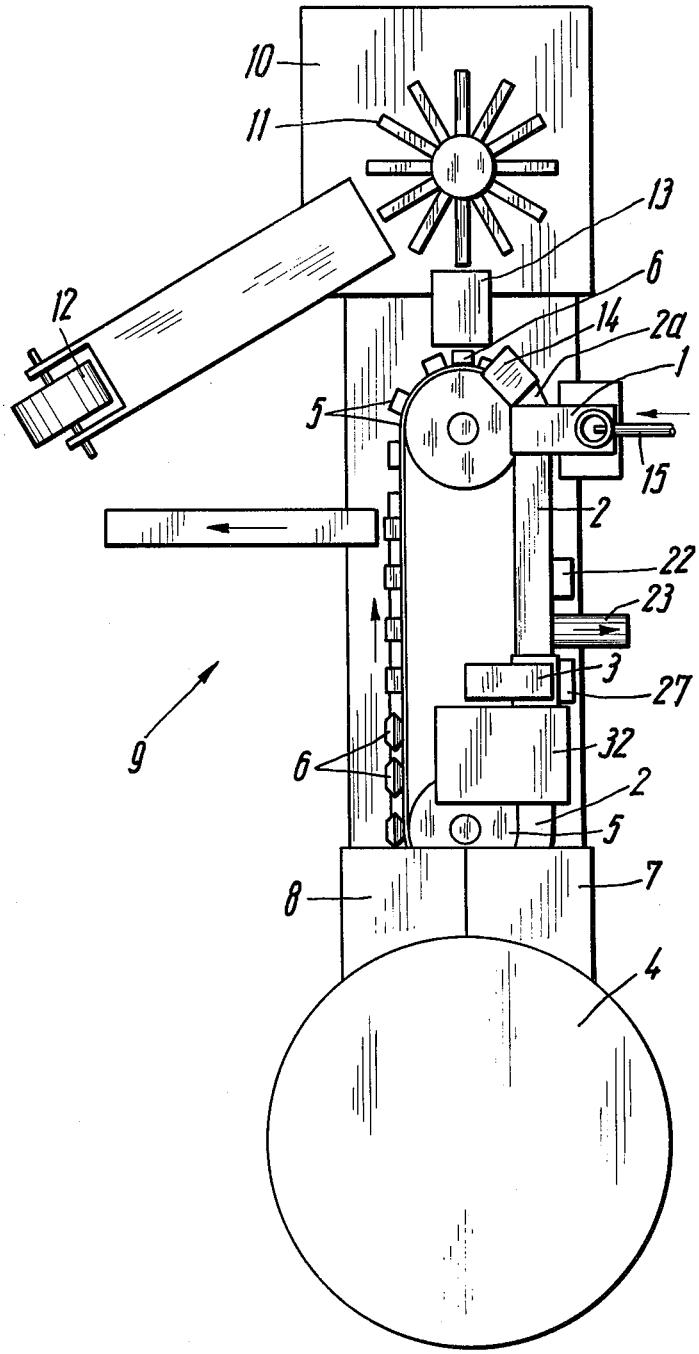
FIG. 1 is a schematic plan view of a packaging machine showing the general arrangement of the work stations.
Figure 2:
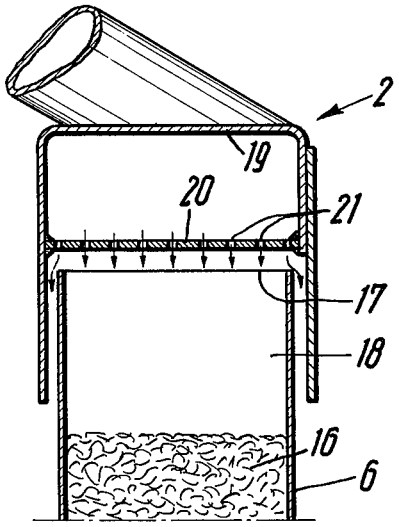
FIG. 2 is a vertical cross-sectional view of a portion of the apparatus shown in FIG. 1.
Figure 4:
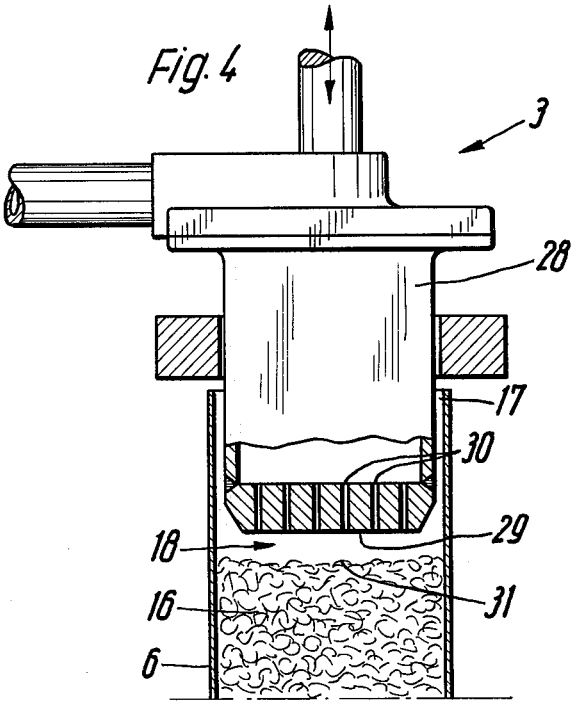
FIG. 4 is a vertical view of a modified gas-flushing device according to the invention.

Referring now the drawings, there is shown part of a packaging machine comprising work stations for forming, filling and gas-flushing, evacuating, and sealing tubular bags. A work station 10 is arranged at one end of a packaging machine 9. The work station 10 has a plurality of forming mandrels 11 around which bag-like packaging containers 6 are formed from gas-tight foil drawn from a storage roll 12. The containers 6 are erected and inserted on a conveyor 5 by a transfer device 13. The conveyor 5 transfers the containers 6 to a gas-flushing station 14 where the air in the container 6 is at least partly replaced with an inert gas before the container 6 moves on to a filling station 1. The filling station 1 has a gas inlet 15 through which the flushing gas is introduced into a filler material 16 during the filling operation. The flushing gas is directed in such a manner that it flows counter to the direction of the filler material 16 and purges the air therefrom.

The conveyor 5 is provided with a cover 2 extending from the vicinity of the filling station 1 approximately to an evacuating station 4 having at least one chamber located at the opposite end of the packaging machine 9 from the bag forming station 10. As the containers 6 are moving on the conveyor 5 to the evacuating station 4, an opening 17 and a head-space 18 of the container 6 are covered and substantially confined by the cover 2.

The cover 2 is comprised of a protective-gas distributing duct 19 in the upper portion thereof. The lower surface of the duct 19 is a gas-permeable plate 20 arranged just above the filling opening 17 of the container 6. The plate 20 contains finely spaced apertures 21 which permit gas to flow from the duct 19 into the head-space 18 of the containers 6. Sufficient flow of the protective gas prevents entry of ambient air, and oxygen, into the containers 6. The gas is substantially confined by a skirt depending from the duct 19 and telescoped over the containers 6.

The portion of the conveyor 5, between the flushing station 14 for empty containers and the filling station 1, may also be covered by a cover 2*a*. In both the covers 2 and 2*a*, the gas-permeable plate may be replaced by a close meshed wire fabric, sintered ceramic plate, or the like.

The conveyor 5 transfers the containers 6 to a weight-checking station 22 and then to an ejecting station 23 arranged along the conveyor 5. The ejecting station 23 removes incorrectly filled containers 6. Since ambient air may enter the head-space 18 of the containers 6 when the supply of protective gas confined by the cover 2 is low, or when the container 6

"breathes" during the weight-checking operation, a protective-gas flushing station 3, arranged after the ejecting station 23, flushes more protective gas into the container 6. While an increased supply of protective gas can eliminate the need for the flushing station 3 and its mechanical complexity, the consumption and cost of the protective gas would be increased. The flushing station 3 can, therefore, be eliminated only when adequately stiff packaging containers are to be filled and sealed.

Figure 3:
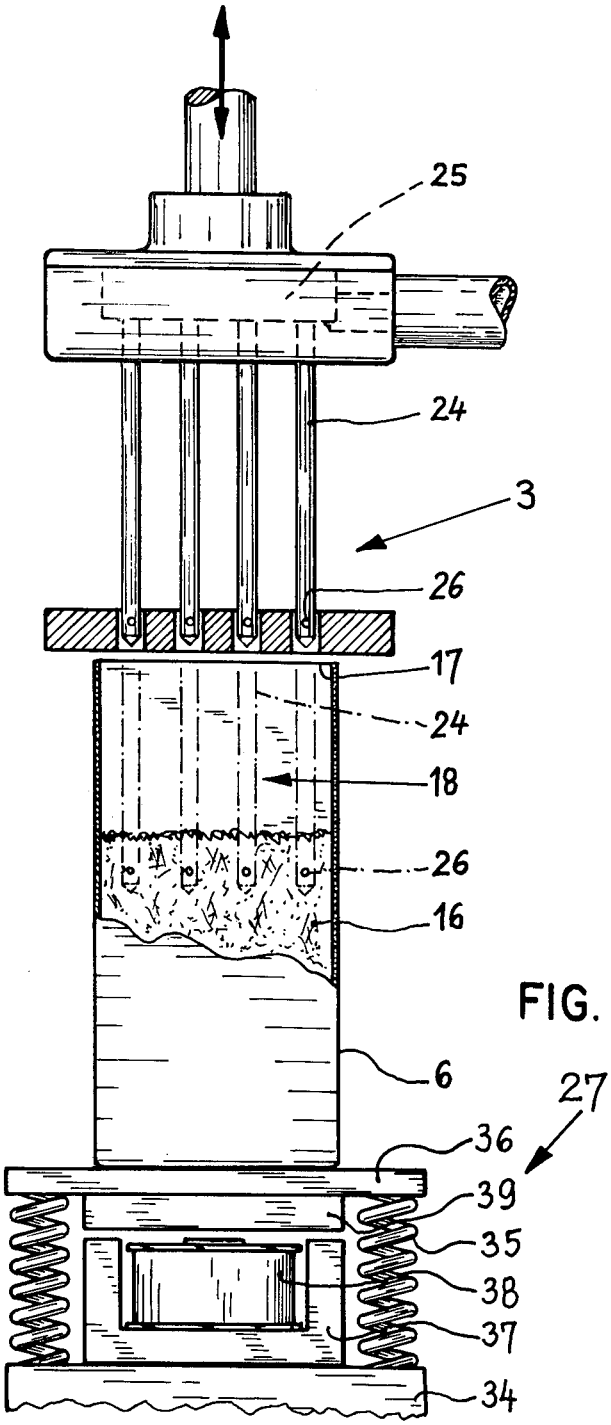
FIG. 3 is a vertical view of a gas-flushing device according to the invention.

The flushing station 3 comprises a gas distributing arrangement. In the preferred embodiment, a plurality of cannula 24 in the form of hollow needles is provided through which the protective gas is introduced from a distributing chamber 25 in the upper portion of the flushing station 3. The cannula 24, which extend essentially coaxial to the length of the packaging container, are lowered into the head space 18 of the container 6 or into the filler material 16 contained in the container 6. The protective gas flows from the distributor chamber 25 through the cannula 24 and apertures 26 located proximate to the terminal ends thereof. The apertures 26 are formed to release the protective gas in a direction substantially perpendicular to the axis of elongation of the cannula 24. This operation purges ambient air from the headspace 18 as well as from the filler material 16. The flushing station 3 may be provided with a shaker device 27 located below the gas distributing chamber as shown in FIG. 3 and between work stations for filling and evacuating the container. The device 27 is effective to shake the material 16 during the flushing operation in order to achieve more thorough flushing.

The shaker 27 is mounted on a stationary support 34 acn comprises an elastically supported table 36, facing container 6. Two spaced helical coil springs 35 are interposed between the table 36 and support 34 as well as an electromagnetic device having a coil 38 disposed in a magnet 37 secured to support 34 and facing an armature 39 attached to table 36. The armature 39 drives magnet 37 to impart movement to table 36 in response to feeding alternating current through coil 38.

An alternate flushing station 3 may be provided for use with dense filler material which differs from the flushing station 3 just described above to the extent that the cannula 24 are replaced by a displacement piston 28. The piston 28 can be lowered into the headspace 18 of the container 6 to displace the ambient air therein with protective gas ejected through apertures 30 in the lower surface 29 of the piston 28. The shaker 27 may again be employed to permit more thorough flushing of the filler material at the surface 31.

After the flushing operation occurs at the flushing station 3, the container 6 may be transferred, if necessary, by the conveyor 5 to a pre-closing station 32 of a conventional type. The container 6 is pre-closed to such an extent that only evacuating openings are left which are relatively easy to close while still allowing access to the gaseous contents. At the same time, the flow of ambient air into the container 6 is inhibited because of the small evacuating openings.

Some types of packaging containers may require flattening means, not shown, for flattening the necks of the containers at the pre-closing station 32. In this event, the flattening means may be provided with ducts for gas flushing.

The container 6 is moved from the pre-closing station 32 by the conveyor 5 to a device 7 which transfers the container 6 from the conveyor 5 to the evacuating station 4, after which the container or bag 6 is completely sealed and then transferred by device 8 back to the conveyor 5. The container 6 is then moved to an exit location of the packaging machine 9.

Figure 5:
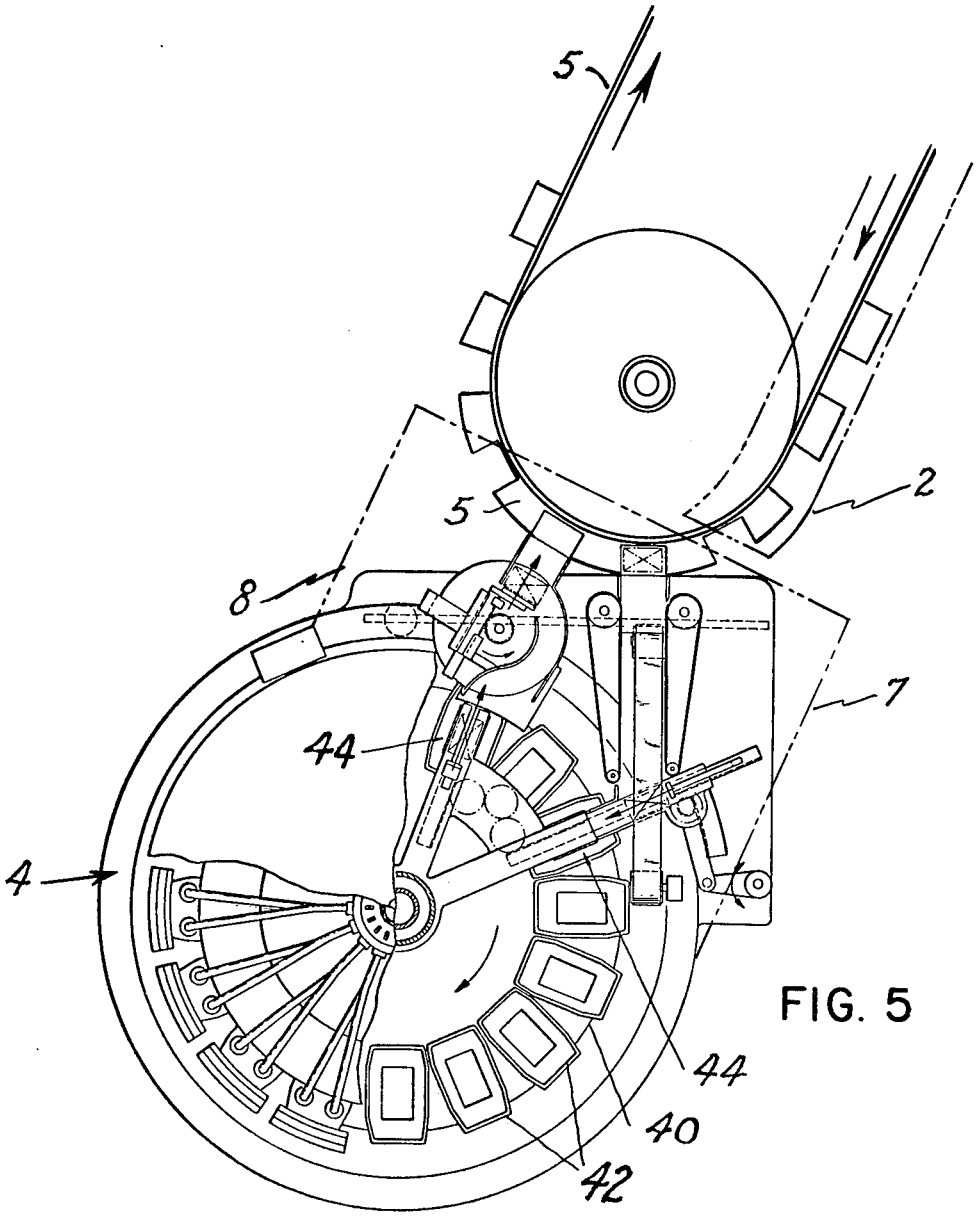
FIG. 5 is a schematic plan view of a conventional evacuation apparatus.

In FIG. 5 there are shown further details of conventional evacuation apparatus 4. The apparatus includes a rotatable drum 40 having evacuating chambers 42, means for transporting the container 44 to and from the chambers, means for regulating the supply of protective gas, etc. Such an apparatus is shown and described in U.S. Pat. No. 3,006,120, dated Oct. 31, 1961, which is incorporated herewith by this reference.

A flushing station 3, equipped with cannula 24, as described above is not restricted to a packaging apparatus equipped with an evacuating device 4. Such cannula 24 may also be used successfully where flushing of the empty packaging container and/or the filler material during the metering or filling operation is omitted. Another use may be in the case where the packaging containers are to be closed under atmospheric pressure. In this case the cannula will be longer and will be immersed almost to the bottom of the packaging container.

While there have been described what are at present considered to be the preferred embodiments of this invention, it will be obvious to those skilled in the art that various changes and modifications may be made therein without departing from the invention, and it is aimed, therefore, in the appended claims to cover all such changes and modifications as fall within the true spirit and scope of the invention.

What is claimed is:

1. In an automatic packaging apparatus for producing low-oxygen content packages:

a plurality of work stations spaced along a predetermined path including a station having a device effective for filling said packages, and a station having a device effective for evacuating gases from filled packages;

conveyor means connecting said work stations and effective to move said packages along said path;

and a conduit for carrying and distributing inert or protective gas, said conduit defining a hood extending to and between said stations comprising said filling and evacuation devices, said hood providing two spaced downwardly extending sidewalls with a distributor plate therebetween provided with a plurality of finely spaced gas outlet apertures.

2. A packaging apparatus according to claim 1, wherein said work stations include a station providing protective gas flushing device located between said filling and evacuating stations, said flushing station being effective to purge the ambient air from the unfilled, or headspace, of the packaging container.

3. A packaging apparatus according to claim 2, wherein said flushing device includes gas distributing means having a piston provided with gas conduits insertable into the packaging container.

4. A packaging apparatus according to claim 2, wherein said station defining a flushing device is provided with a plurality of downwardly extending cannula having a common support and being simultaneously immersible into said filler material contained within said package.

5. A packaging apparatus according to claim 2, and a station providing a shaker device effective to act upon said filler material within said container, said shaker being arranged between said filling and evacuating work stations and adjacent to said flushing station.

6. A packaging apparatus according to claim 5, wherein said shaker device is arranged below said gas flushing station.

7. A packaging apparatus according to claim 5, wherein said shaker device is operable simultaneously with said flushing device.

* * * * *

UNITED STATES PATENT OFFICE

CERTIFICATE OF CORRECTION

Patent No. 3,942,301 Dated March 9, 1976

Inventor(s) Klaus Domke

It is certified that error appears in the above-identified patent and that said Letters Patent are hereby corrected as shown below:

At column 1, line 5, after "abandoned" the period (.) has been deleted and the following phrase inserted --, which claims priority based upon German Patent Application No. P 22 28 056.4 filed June 9, 1972.--

Signed and Sealed this

Twenty-fourth Day of May 1977

[SEAL]

*Attest:*

RUTH C. MASON
*Attesting Officer*

C. MARSHALL DANN
*Commissioner of Patents and Trademarks*